US006962334B2

(12) United States Patent
Erkelenz

(10) Patent No.: US 6,962,334 B2
(45) Date of Patent: Nov. 8, 2005

(54) DELIVERY APPARATUS FOR FLAT ARTICLES, ESPECIALLY ROTARY CUT SHEETS

(75) Inventor: Willi Erkelenz, Langenfeld (DE)

(73) Assignee: EHA Spezialmaschinenbau GmbH, Steffenberg (DE)

( * ) Notice: Subject to any disclaimer, the term of this patent is extended or adjusted under 35 U.S.C. 154(b) by 0 days.

(21) Appl. No.: 10/842,709

(22) Filed: May 7, 2004

(65) Prior Publication Data

US 2004/0251604 A1 Dec. 16, 2004

(30) Foreign Application Priority Data

May 9, 2003 (EP) ..... 03010464

(51) Int. Cl.[7] ..... B65H 29/68

(52) U.S. Cl. ..... 271/183; 271/211

(58) Field of Search ..... 271/183, 211, 309

(56) References Cited

U.S. PATENT DOCUMENTS 5,882,175 A * 3/1999 Villacieros Fernandez .. 414/790

FOREIGN PATENT DOCUMENTS

| | | | | |
|---|---|---|---|---|
| EP | 0 328 707 | * | 8/1989 | ..... B65H 29/00 |
| EP | 0 408 893 | | 1/1991 | |
| JP | 59-53356 | * | 3/1984 | ..... B65H 31/34 |

* cited by examiner

*Primary Examiner*—Donald Walsh
*Assistant Examiner*—Kenneth W. Bower
(74) *Attorney, Agent, or Firm*—Herbert Dubno

(57) ABSTRACT

A delivery device for stacking cut flat articles such as rotary cross cut sheets has a braking table downstream of a sheet feeder which is provided with two counterrotating disks which are perforated and communicate with suction passages on the table beneath the disks to brake the sheets as they are supplied to a stacker. At the edge of this table, there is a broad slit nozzle directing a sheet of air upwardly onto the underside of the sheets which are delivered to the stacker.

17 Claims, 3 Drawing Sheets

DELIVERY APPARATUS FOR FLAT ARTICLES, ESPECIALLY ROTARY CUT SHEETS

FIELD OF THE INVENTION

My present invention relates to a delivery or stacking apparatus for flat articles and especially such articles which have been cut from a larger piece, e.g. sheets which have been cut by a rotary cross cutter from a web.

BACKGROUND OF THE INVENTION

A delivery apparatus for flat articles such as rotary cross-cut sheets, can comprise a feeder for the cut sheets, a suction braking table for braking the sheets which are fed thereacross, and a stacking unit downstream of the braking device forming the sheets into stacks. In the feed device, a sheet or signature can be accumulated with respect to a significantly delivered sheet. In other words, in the direction of travel of the sheets, there is an acceleration of the sheets with respect to the feed speed of the sheets before the feed unit. To ensure that the sheets will be reliably stacked, the suction braking table effects a reduction in the speed with these sheets travel before they meet the stacker. On the suction braking table, there is normally an overlapping of a braked sheet with respect to the subsequently supplied sheet.

A device of this type has been described in EP 0 408 893 B1 and has a suction braking table across which a suction belt is displaced over rerouting rollers. The rerouting rollers or the suction belt are seated, inter alia, on a driven shaft of the feed device. The cost of such a unit is comparatively high and improvements are required in the reliability of the stacking of sheets therewith.

OBJECTS OF THE INVENTION

It is, therefore, the principal object of the present invention to so improve a delivery apparatus of the type described, that it will be simplified, of high reliability and of low cost.

Another object of this invention is to provide a delivery apparatus that can eliminate the need for the endless belt of the prior art version.

It is also an object of the invention to provide a delivery apparatus which is compact, of low capital cost and is easily maintained and operated.

SUMMARY OF THE INVENTION

These objects are attained, in accordance with the invention in a delivery apparatus for flat articles, especially rotary cross cut sheets, which comprises:

a feeder for displacing a succession of flat articles in a direction along a path;

a suction brake table along the path downstream from the feeder and having a surface at which a suction is generated to draw the articles against the surface and brake travel of the articles in the direction;

a stacking device along the path downstream of the suction brake for collecting the articles in a stack; and at least two substantially coplanar rotary brake disks mounted on the table, forming the surface and each provided with a multiplicity of suction openings communicating, upon rotation of the respective disk, with respective upwardly open suction passages drawing air through the suction openings.

According to the invention, therefore, the suction brake table is provided on the side which actually is contacted by the sheets and which draws the sheets against the table with two rotating brake disks, each of which has a multiplicity of suction openings which can communicate between a suction source on the table and the underside of the sheets. Each of the brake disks may be rotatable above at least one suction opening through which air is drawn into the openings of the suction plates. The upper surfaces of the brake disks form an upper surface of the suction brake table. When it is indicated here that the rotating brake disks lie upon the suction brake table, it is meant that the suction disks are located only a very short distance from the supporting surfaces of that table so that a reliable rotation is ensured.

Preferably the feeder or feed unit comprises a grooved roller which has a multiplicity of roller segments spaced apart from one another by respective grooves. The grooved roller in turned is juxtaposed with a pressing roller bearing upon the grooved roller so that the sheets passing between the pressing roller and the grooved roller are substantially positively fed. The roller segments whose spacing defines the groove between them are keyed or otherwise rotationally fixed to a driven shaft.

In the feed unit there is an acceleration of the sheets relative to the speed of advance of the sheets to the feed unit or directly downstream from the rotary cutter.

According to a highly preferred feature of the invention between the rolled segments or lands of the grooved roller, blowing nozzles are provided which direct their jets from below onto the sheets in the direction of travel thereof. Preferably these nozzles are oriented with an inclination upwardly.

It is within the scope of the invention to provide the two brake plates so that they are substantially adjacent one another transversely of the direction of advance of the sheets, i.e. are slightly spaced apart across the path of the sheets and are rotated in opposite senses. The direction of advance of the sheets is, of course, the transport direction or direction of displacement of the sheets toward the stacking unit. Preferably one of the brake plates or disks is rotated in the crosswise sense while the other brake plate or disk is rotated in the counterclockwise sense. The two brake plates may have their plate halves which are proximal to one another or substantially adjoin, rotating in the direction of advance or the feed direction of the sheets.

Preferably the suction openings in the brake plate surfaces and which traverse the brake plates or disks are substantially uniformly distributed at least over the periphery of each brake plate or disk and preferably uniformly over the entire surface. The brake plates or disks can be circular, at least as seen in a plane view onto the brake table and the suction openings can be spaced apart along respective radii, which, in turn, can be angularly equispaced about the axes of rotation of the disks. In that configuration, openings which lie in an imaginary circle are equally spaced and the spacing may reduce from circle to circle inwardly. Alternatively the disks may be uniformly perforated.

The suction openings in the brake disks or plates can communicate with a suction passage located below that disk or plate. That suction passage can preferably be of the shape of a circular sector. The suction passages can also have circular configurations or can be circular cutouts. Any circularly segmental configuration of the suction passage can correspond to the shape of the brake disk, i.e. can be bounded by a radius of the brake disk and be bounded by the periphery of the disk as well.

Preferably the radius of the circular sector forming a suction passage is equal to or smaller than the radius of a circular brake disk. The suction passage can then be completely covered by the respective brake plates or disk. In an embodiment of the invention which is highly advantageous, the circular sector suction passage can lie over a quadrant of the circle so that the sector angle α can amount to 90° or approximately 90°. The sector itself can be offset from the direction of advance and thus a straight line through the axis of rotation of the disk in the direction of advance by an angle β of 3 to 45°, preferably 3 to 30° and most advantageously some 3 to 20°. In other words the radius of the circular sector suction passage may form the aforementioned angle β with a respective one of the aforementioned straight lines.

In a highly preferred embodiment of the invention, each suction passage lies beneath the path of the respective plate or disk which neighbors the other. The suction passages are preferably mirror symmetrical with one another with respect to an imaginary symmetry plane midway between the two brake disks or plates.

It will be understood that at least one suction passage is provided for each plate or disk whereby air is drawn through the suction openings in the disks or plates and through the suction brake table itself. Because of this suction, the sheets which pass over the brake table are reliably slowed by being drawn against the rotating surfaces of the disks which are driven synchronously with a single drive device or by two or more drive devices.

Preferably the inclination of the surface of the suction brake table in the direction of advance of feed direction of the sheets is adjustable. The suction table surface can be inclined upwardly or downwardly in the direction of advance of the sheets.

The suction brake table, at its side turned toward the stacking device can have at least one air nozzle which directs an air stream from below onto the sheets as they travel from the suction brake table onto the stack. The air nozzle thus provides a supporting cushion of air which allows the sheet to carry onto the stack and deposit thereon in a uniform manner. The nozzle can be provided all along the edge of the table so that the support air is provided over the full width of the sheet. It is possible to provide the air nozzle beneath the suction brake table and beneath the braking plate or disk. Preferably it is provided as a broad slit nozzle which can extend over at least 50% of the width b the end of the sheet to be stacked. Of course a corresponding blower can be provided for producing the blowing air which is supplied to this nozzle.

With the sheet shacking arrangement of the invention, a highly reliable and effective braking of the sheets coming from the feeder can be achieved and their deposit on the stack is likewise made more reliable and uniform than has hitherto been the case, the quality of the stacked sheets and the stack itself. Problems such as tearing, folding, corrugation-like bending and even buckling of the sheets can be eliminated. In addition, the stacking system overall, of relatively simple and economical construction and the suction braking table does not exert on the sheets any significant detrimental transverse forces.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
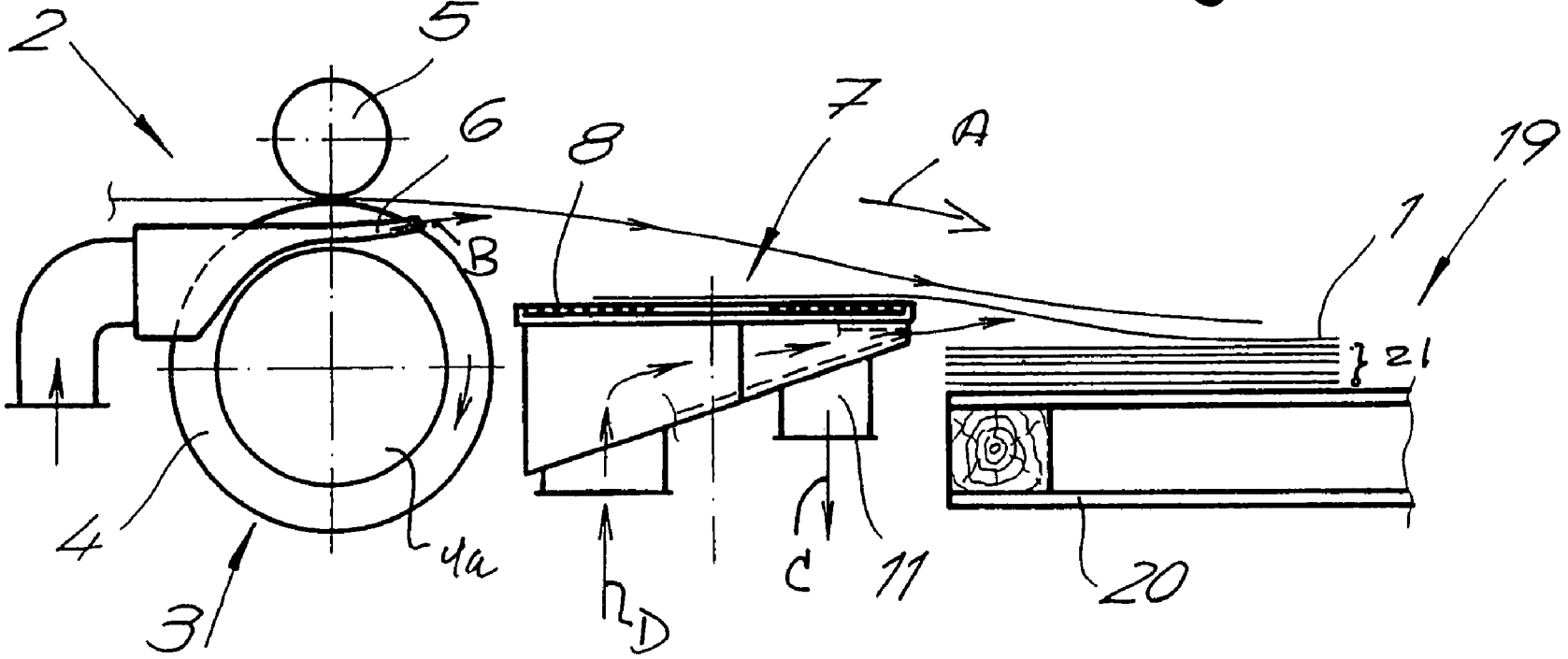
FIG. 1 is a diagrammatic cross sectional view through the delivery apparatus of the invention.

The drawing shows a delivery apparatus for cut flat particles and especially sheets 1 which are delivered in succession from a rotary cross cutter which has not been illustrated.

At the upstream side of the apparatus, there is a feeder 2 for the sheets 1 which includes a grooved roller 3 and a plurality of pressing rollers 5 which press the sheets 1 against the roller segments or lands 4 of this roller. The roller segments 4 are rings which are rotatably entrained by a sheath 4*a* and between the segment 4 there are grooves 4*b* as can be seen in FIG. 2.

Figure 2:
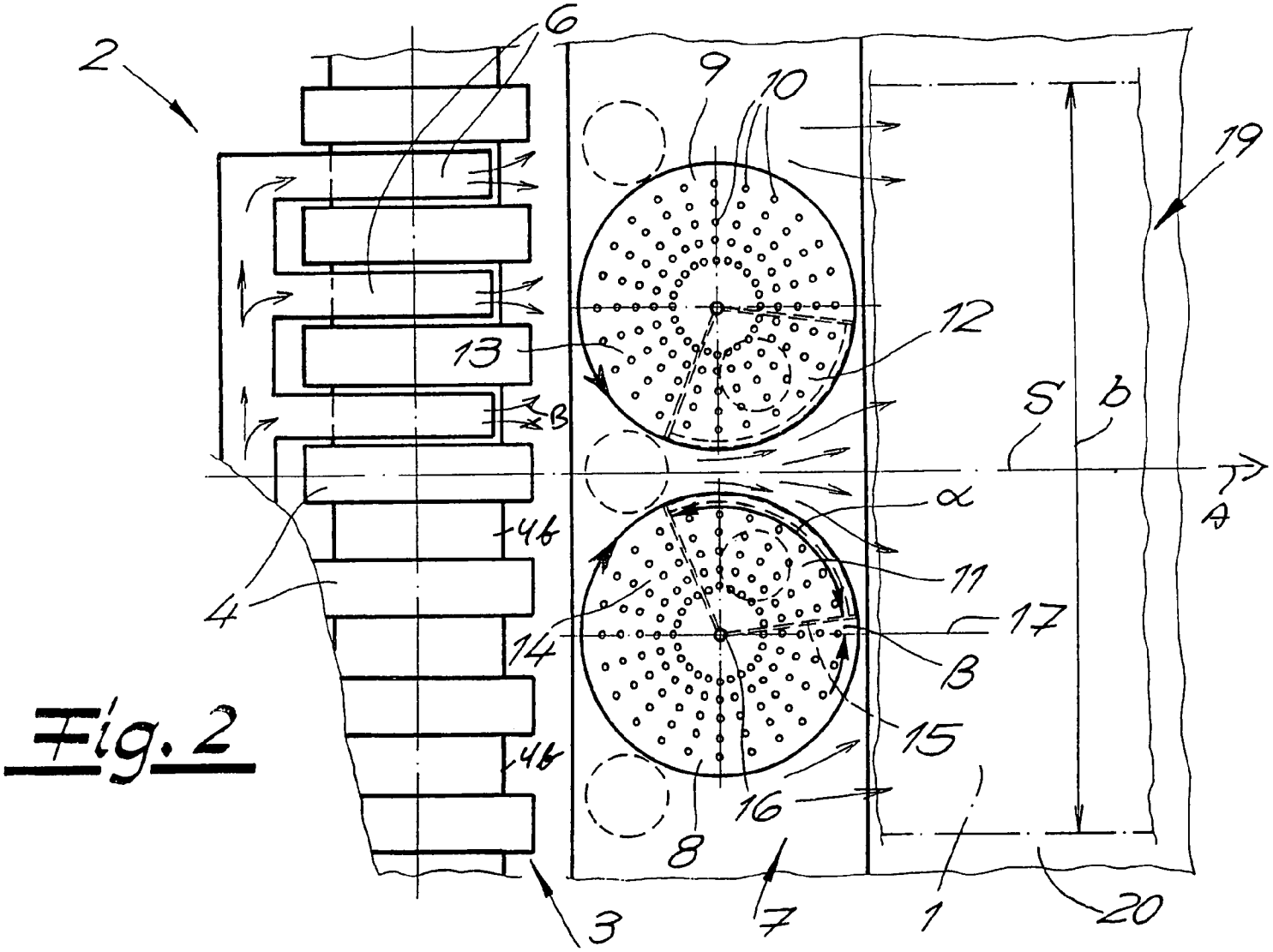
FIG. 2 is a plan view of the part of the apparatus in FIG. 1.
Figure 3:
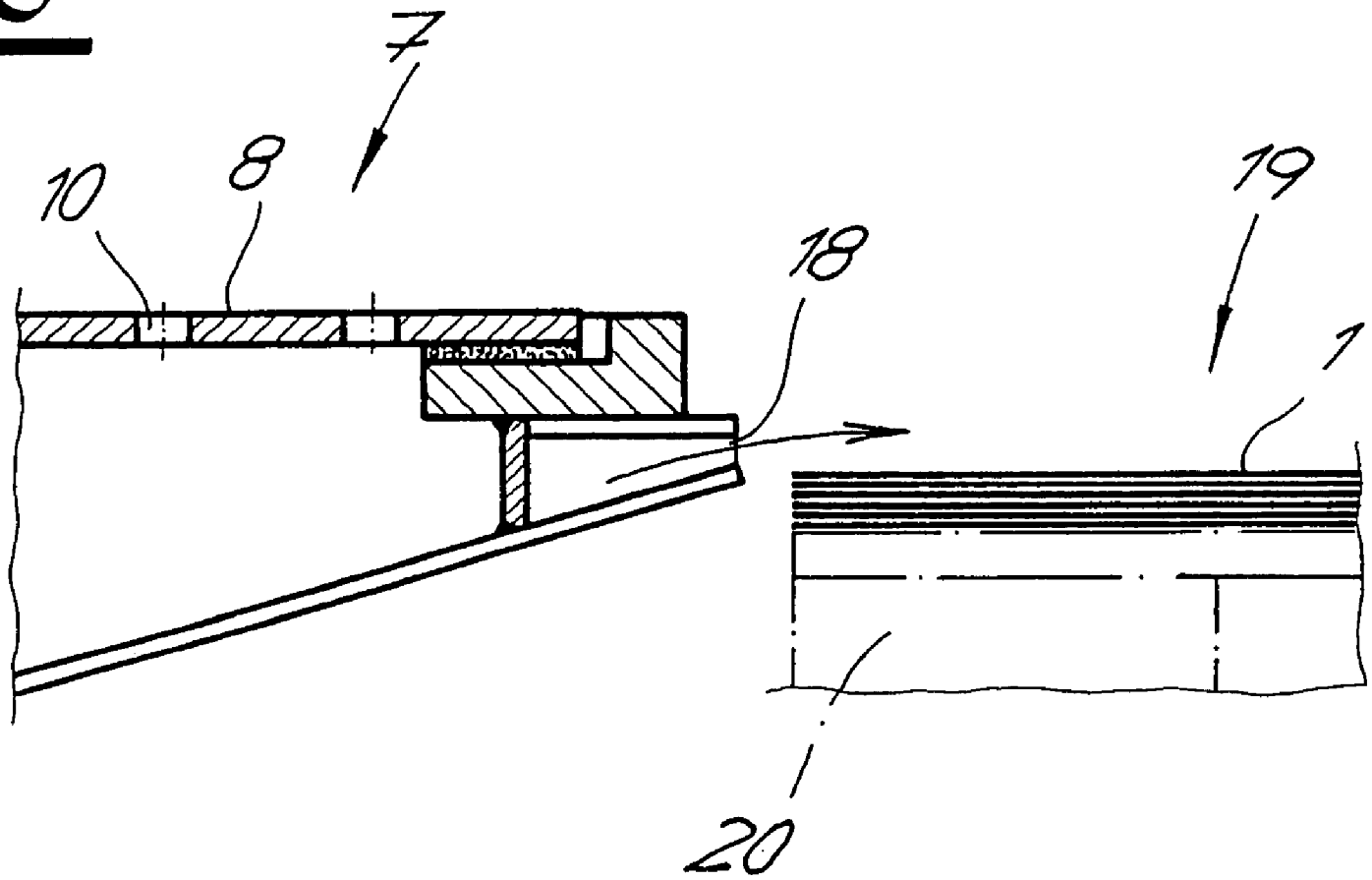
FIG. 3 is a detail of a portion of the apparatus in FIG. 1.

In the embodiment illustrated in FIGS. 1 and 2 and as seen in FIG. 2, the feeder 2 effects the acceleration of the sheets 1 in the feed direction represented by the arrow A (FIGS. 1 and 2). Between the rolled segments 4 and in the grooves 4*b* are nozzles 6 which direct jets of air upwardly against the undersides of the sheets as represented by the arrows B.

The apparatus also includes a suction braking table 7 downstream of the feeder 2 for braking the travel of the sheets 1. On the suction braking table are two rotating brake disks or plates 8, 9 which have their braking upper surfaces in a common plane parallel to the surface of the table 7. Each brake disk 8, 9 has a multiplicity of suction openings 10. Beneath each brake disk 8, 9 a respective suction passage 11, 12 is provided to draw air from above from the openings of the disks 8 and 9. The suction passages 11, 12 are connected to a vacuum pump as represented by the arrow C. The arrow D (FIG. 1) represents a connection to a blower.

The brake disks 8, 9 are rotated in opposite senses, i.e. the brake disk 8 is rotated in the clockwise sense while the brake disk 9 is rotated in the counterclockwise sense. The rotation of the brake disks on their sides proximal to one another along the respective paths of the sheet 1 is in the direction (arrow A) of the travel of the sheets. The two neighboring disk halves are indicated at 13 and 14.

From FIG. 2 it can also be seen that the suction openings are uniformly distributed over the periphery of the brake disks 8, 9 and are likewise distributed uniformly inteh radial direction.

In a preferred embodiment, each suction passage 11, 12 has the form of a circular segment which is completely covered by the respective disk 8, 9. The sectors have sector angles α of about 105° in this embodiment so that each sector is slightly greater than the quadrant. The radial boundary 15 of the sectors define with straight lines 17 through the center of rotation 16 of each disk in the direction of travel of the sheets 1, an angle β of about 5°. FIG. 2 shows that the suction openings 11, 12 are mirror symmetrical with respect to the symmetry plane S.

The suction delivered through the opening 10 draws the sheets against the surfaces of the disk and thereby effectively brakes the sheets in their travel.

The suction braking table 7 is also provided with a broad slot nozzle 18 which supplies air to the undersides of the sheets traveling from the braking table 7 to the stacker 19. This nozzle has a length of at least 50% of the width b of the sheet to be deposited and is connected to the blower as represented by the arrow D. The sheets 1 are thus deposited in a stack 21 on, for example, a pallet 20 of the stacking unit.

I claim:

1. A delivery apparatus for flat articles comprising:

a feeder for displacing a succession of flat articles in a direction along a path;

a suction brake table along said path downstream from said feeder and having a surface at which a suction is generated to draw said articles against said surface and brake travel of said articles in said direction;

a stacking device along said path downstream of said suction brake for collecting said articles in a stack; and at least two substantially coplanar rotary brake disks mounted on said table, forming said surface and each provided with a multiplicity of suction openings communicating, upon rotation of the respective disk, with respective upwardly open suction passages drawing air through said suction openings.

2. The delivery apparatus defined in claim 1 wherein said feeder comprises a grooved roller having a multiplicity of axially spaced roller segments separated by respective annular grooves, and at least one pressing roller bearing against said grooved rollers, said articles passing between said rollers.

3. The delivery apparatus defined in claim 2 wherein respective blowing nozzles are provided between said segments in said grooves to direct respective air streams onto undersides of said articles between said feeder and said suction brake table.

4. The delivery apparatus defined in claim 3 wherein said rotary brake disks are alongside one another across a width of said path and transverse to said direction, said disks being rotated in opposite senses.

5. The delivery apparatus defined in claim 4 wherein each of said disks underlies a respective half of the path and of the articles displaced along said path.

6. The delivery apparatus defined in claim 5 wherein said suction openings are uniformly distributed over said disks.

7. The delivery apparatus defined in claim 6 wherein said suction passages have configurations of circular segments opening below said disks.

8. The delivery apparatus defined in claim 7 wherein said suction passages open beneath the respective halves of said disks which are proximal to each other.

9. The delivery apparatus defined in claim 8 wherein said suction braking table has an air nozzle on a downstream side thereof directing an air stream onto an underside of an article traveling from said table to said stacking device.

10. The delivery apparatus defined in claim 9 wherein said air nozzle on said downstream side of said suction braking table is a wide-slit nozzle.

11. The delivery apparatus defined in claim 1 wherein said articles are sheets produced by a rotary cross cutter and said rotary brake disks are alongside one another across a width of said path and transverse to said direction, said disks being rotated in opposite senses.

12. The delivery apparatus defined in claim 1 wherein said articles are sheets produced by a rotary cross cutter and each of said disks underlies a respective half of the path and of the articles displaced along said path.

13. The delivery apparatus defined in claim 1 wherein said articles are sheets produced by a rotary cross cutter and said suction openings are uniformly distributed over said disks.

14. The delivery apparatus defined in claim 1 wherein said articles are sheets produced by a rotary cross cutter and said suction passages have configurations of circular segments opening below said disks.

15. The delivery apparatus defined in claim 1 wherein said articles are sheets produced by a rotary cross cutter and said suction passages open beneath the respective halves of said disks which are proximal to each other.

16. The delivery apparatus defined in claim 1 wherein said articles are sheets produced by a rotary cross cutter and said suction braking table has an air nozzle on a downstream side thereof directing an air stream onto an underside of an article traveling from said table to said stacking device.

17. The delivery apparatus defined in claim 16 wherein said air nozzle on said downstream side of said suction braking table is a wide-slit nozzle.

* * * * *